United States Patent [19]

Goltz et al.

[11] Patent Number: 5,037,040

[45] Date of Patent: Aug. 6, 1991

[54] FIN STABILIZED SUBAMMUNITION BODY

[75] Inventors: Gerhard Goltz, Celle; Werner Grosswendt, Ratingen; Helmut Peller, Hohenkirchen; Jens Seidensticker, Bodmann, all of Fed. Rep. of Germany

[73] Assignee: Rheinmetall GmbH, Düsseldorf, Fed. Rep. of Germany

[21] Appl. No.: 485,900

[22] Filed: Mar. 1, 1990

[30] Foreign Application Priority Data

Mar. 1, 1989 [DE] Fed. Rep. of Germany ..... 3906372

[51] Int. Cl.[5] ..... F42B 10/66

[52] U.S. Cl. ..... 244/3.22

[58] Field of Search ..... 244/3.22, 3.2; 102/384

[56] References Cited

U.S. PATENT DOCUMENTS 3,282,540 11/1966 Lipinski ..... 244/3.22
3,304,434 5/1962 Swaim et al. ..... 244/3.22
4,533,094 8/1985 Geis et al. ..... 244/3.22
4,568,040 2/1986 Metz ..... 244/3.22
4,598,884 7/1986 Speer .

FOREIGN PATENT DOCUMENTS 0028966 5/1981 European Pat. Off. .

*Primary Examiner*—Charles T. Jordan
*Attorney, Agent, or Firm*—Spencer & Frank

[57] ABSTRACT

A fin stabilized subammunition body including a target detection device and being ejectable in a target area from a spin stabilized artillery carrier projectile. The target detection device includes a fixed sensor for detecting a target and producing target signals representing characteristics of the detected target, a reference platform for producing inertial reference signals, and a controller connected to the fixed sensor and the reference platform for producing drive control signals for selectively actuating a plurality of microreaction drive mechanisms arranged for producing transverse acceleration forces for aligning the body with a detected target.

10 Claims, 2 Drawing Sheets

FIN STABILIZED SUBAMMUNITION BODY

CROSS REFERENCE TO RELATED APPLICATION

This application claims the priority of Application Ser. No. P 39 06 372.0, filed Mar. 1st, 1989, in the Federal Republic of Germany, the subject matter of which is incorporated herein by reference.

BACKGROUND OF THE INVENTION

The present invention relates to a fin stabilized subammunition body having a target detection device and being ejectable in a target area from a spin stabilized artillery carrier projectile.

A prior art subammunition body of this type is customarily accommodated in an artillery shell which is fired by indirect ranging in a spin stabilized manner. As soon as the given target area is reached, the subammunition body is ejected in a known manner from the carrier shell, is braked and its spin is removed. After the subsequent unfolding of its stabilization fins and activation of an energy supply for a target detection device, an appropriate search head detects ground targets during the stabilized descending flight of the subammunition body and, if necessary, the subammunition body is aligned with the detected target.

In prior art subammunition bodies of this type, movable components, such as, for example, a gimbal mounted search head, a conventional gyro and conventional setting drives or rudder elements, are required for target detection and alignment of the subammunition body with the target. However, these movable components reduce, in an undesirable manner, the firing stability and thus the reliability of such subammunition bodies. Moreover, they involve highly complex designs and result in undesirable cost developments.

SUMMARY OF THE INVENTION

It is therefore an object of the present invention to avoid as many movable components as possible in a subammunition body which is distinguished by a simple and economical construction and high firing resistance and reliability.

The above and other objects are accomplished according to the invention in the context of a subammunition body of the type first described above wherein the target detection device includes a fixed sensor for detecting a target and producing target signals representing characteristics of the detected target, a reference platform for producing inertial reference signals, and a controller connected to the fixed sensor and the reference platform and responsive to the target signals and the inertial reference signals for producing drive control signals; and wherein there is further provided a plurality of microreaction drive mechanisms arranged along the circumference of the subammunition body and responsive to the drive control signals for producing transverse acceleration forces for aligning the body with a detected target.

BRIEF DESCRIPTION OF THE DRAWINGS

The invention will now be described in greater detail with reference to an embodiment thereof.

DETAILED DESCRIPTION OF THE PREFERRED EMBODIMENT

Figure 1:
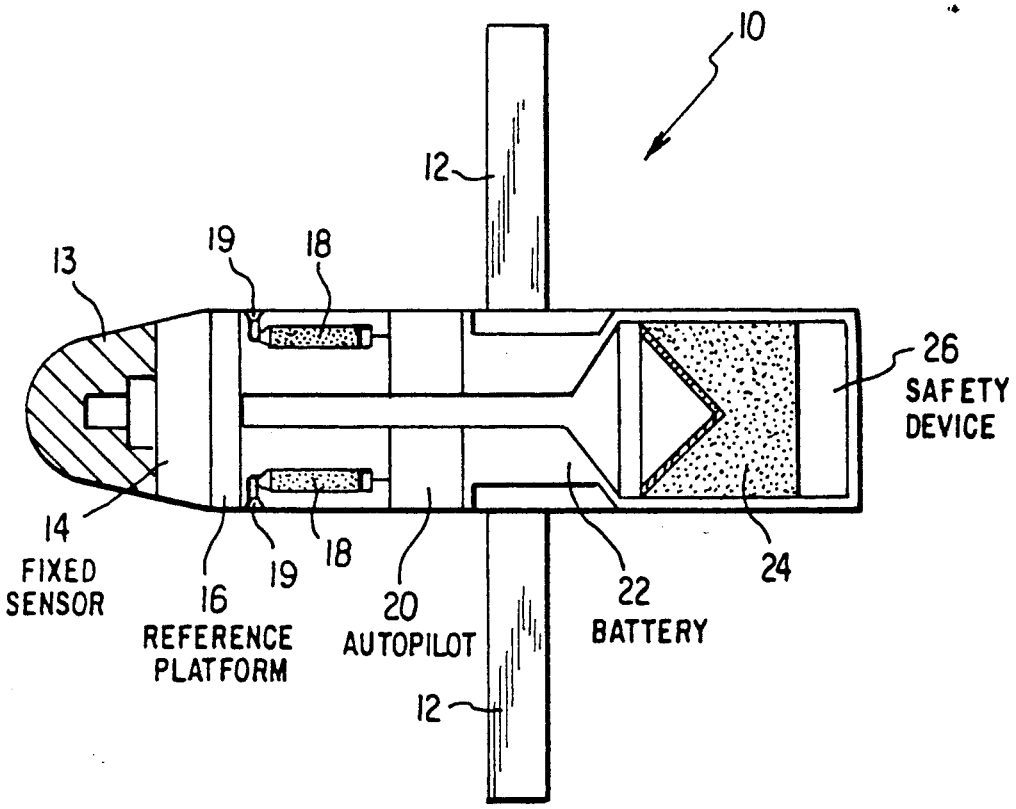
FIG. 1 is a schematic showing a longitudinal section of a fin stabilized subammunition body according to the invention.

Referring to FIG. 1 there is shown a preferred embodiment of a fin stabilized subammunition body 10 according to the invention. Body 10 has a longitudinal axis (not shown) and includes several guide fins 12 which are pivotable in a known manner to pivot into the position shown when released from a carrier projectile to serve as a guide mechanism. In its nose portion 13, subammunition body 10 is provided with a fixed sensor 14, preferably an infrared sensor or a focal plane array, for searching for and detecting a target. An inertial reference platform 16, for example, a triaxial laser gyro, is arranged immediately behind fixed sensor 14 within subammunition body 10.

Behind reference platform 16, there are disposed a plurality of microreaction drive mechanisms or thrusters 18 around the circumference of subammunition body !0 and parallel to the longitudinal axis. These drive mechanisms ar individually fireable and function as small rocket engines which burn just once to generate thrust. Radial bores 19, which constitute thrust nozzles, are provided in subammunition body 10 for the generation of thrust from the combustion products resulting from microreaction drive mechanisms 18. Preferably, micro-reaction drive mechanisms 18 are arranged ahead of the center of gravity of subammunition body 10, immediately behind fixed sensor 14 and reference platform 16, so that the generated thrusts adjust the angle of attack of fin stabilized subammunition body 10. That is, microreaction drive mechanisms 18 generate a transverse acceleration which, together with the lift of subammunition body 10 and with fins 12, align body 10 with a detected target. The individual microreaction drive mechanisms 18 may be designed to have a very small size so that 100 or and more microreaction drive mechanisms 18 can be accommodated in a suitable subammunition body 10, thus permitting quasi-continuous guidance of body 10.

Subammunition body 10 additionally includes an electronic unit or autopilot 20, which is responsive to the target characteristics detected by sensor 14 and to the inertial reference signals of reference platform 16 for producing control drive signals for selectively actuating microreaction drive mechanisms 18 for aligning body 10 with a detected target. A battery 22 is provided to furnish a current supply for the electronics in body 10.

Further, for completeness, body 10 includes a warhead 24 and a firing and safety device 26 which are configured and arranged in a manner known to those skilled in the art.

Figure 2:
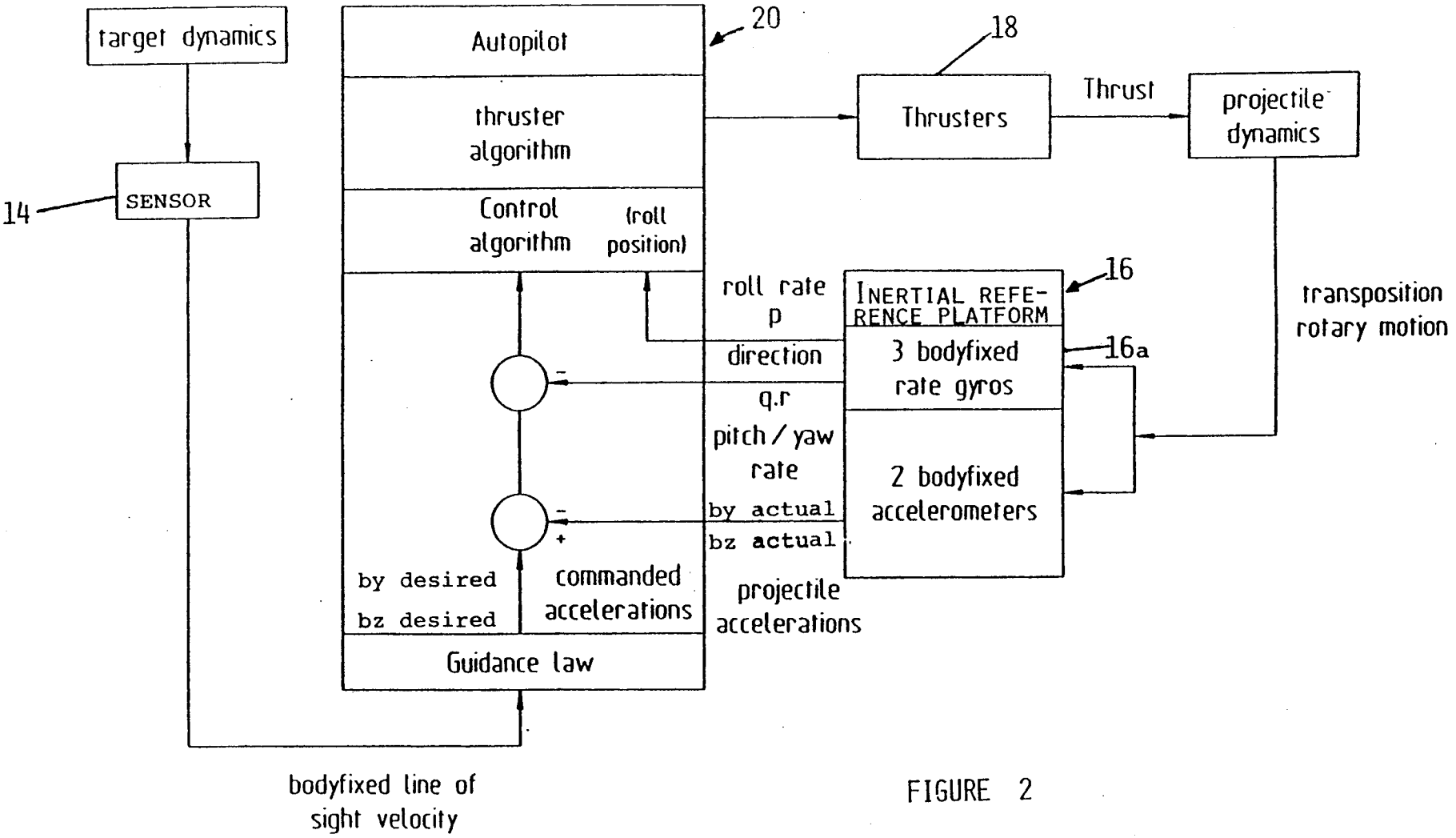
FIG. 2 is a block circuit diagram of guidance and control electronics for use in the embodiment of FIG. 1.

Referring to FIG. 2 there is shown a control and guidance block circuit diagram which includes the autopilot 20 connected for receiving target signals from sensor 14 and inertial reference signals from inertial platform 16. In this embodiment inertial platform 16 includes three body-fixed rate gyros **16*a* for providing roll, pitch and yaw rate signals to autoplate 20 and two body-fixed accelerometers for providing projectile acceleration signals in the y and z directions. Autopilot 20 produces thruster drive or actuating signals for selectively actuating thrusters 18 to align body 10 with a target based upon the sensor signals and inertial reference signals from sensor 14 and inertial reference platform 16, respectively. Autopilot 20** essentially comprises a processor which is programmed with a guidance law, control algorithm and thrustor algorithm for producing the appropriate thrustor drive signals in response to the sensor and inertial reference platform signals which are fed to the autopilot.

Obviously, numerous and additional modifications and variations of the present invention are possible in light of the above teachings. It is therefore to be understood that within the scope of the appended claims, the invention may be practiced otherwise than as specifically claimed.

What is claimed is:

1. In a fin stabilized subammunition body including target detection means and being ejectable in a target area from a spin stabilized artillery carrier projectile, the improvement wherein :

said target detection means includes a fixed sensor for detecting a target and producing target signals representing characteristics of the detected target, a reference platform for producing inertial reference signals, and control means connected to said fixed sensor and said reference platform and responsive to said target signals and said inertial reference signals for producing drive control signals; and further including:

a plurality of microreaction drive means arranged along the circumference of the subammunition body, said drive control signals selectively actuating said plurality of microreaction drive means for producing transverse acceleration forces for aligning the body with a detected target.

2. A subammunition body as defined in claim 1, wherein said microreaction drive means are disposed ahead of the center of gravity of the subammunition body.

3. A subammunition body as defined in claim 1, wherein said control means includes an electronic evaluation and control means for evaluating target characteristics detected by said fixed sensor and for producing drive control signals which provide positive actuation of said microreaction drive means.

4. A subammunition body as defined in claim 1, wherein said fixed sensor comprises an infrared sensor.

5. A subammunition body as defined in claim 1, wherein said fixed sensor comprises a focal plane array.

6. A subammunition body as defined in claim 1, wherein said microreaction drive means comprise small rocket engines which are individually fireable and burn only once to generate thrust.

7. A subammunition body as defined in claim 6, wherein said body includes radial bores communicating with said microreaction drive means for generating a radially directed thrust.

8. A subammunition body as defined in claim 1, wherein said microreaction drive means are disposed ahead of the center of gravity of the subammunition body and behind said fixed sensor and said reference platform.

9. A subammunition body as defined in claim 1, wherein said reference platform comprises a triaxial laser gyro.

10. A subammunition body as defined in claim 1, wherein said reference platform comprises rate gyros and accelerometers.

* * * * *